US009391362B1

(12) United States Patent
Kim et al.

(10) Patent No.: US 9,391,362 B1
(45) Date of Patent: Jul. 12, 2016

(54) CONFIGURABLE ANTENNA

(71) Applicant: AMAZON TECHNOLOGIES, INC., Reno, NV (US)

(72) Inventors: Cheol Su Kim, San Jose, CA (US); In Chul Hyun, San Jose, CA (US); Tzung-I Lee, San Jose, CA (US)

(73) Assignee: Amazon Technolgoies, Inc., Reno, NV (US)

( * ) Notice: Subject to any disclaimer, the term of this patent is extended or adjusted under 35 U.S.C. 154(b) by 325 days.

(21) Appl. No.: 13/764,217

(22) Filed: Feb. 11, 2013

(51) Int. Cl.
*H01Q 1/36* (2006.01)

(52) U.S. Cl.
CPC ..... *H01Q 1/36* (2013.01)

(58) Field of Classification Search
CPC . H01Q 1/2258; H01Q 1/2266; H01Q 1/2275; H01Q 1/2291; H01Q 1/241; H01Q 1/242; H01Q 1/38; H01Q 5/314; H01Q 5/321; H01Q 5/328; H01Q 5/364; H01Q 5/371; H01Q 5/378; H01Q 5/392; H01Q 5/40; H01Q 9/30; H01Q 9/42
USPC ..... 343/700 MS, 702, 724, 833, 834, 850, 343/860, 876
See application file for complete search history.

(56) References Cited

U.S. PATENT DOCUMENTS 5,420,599 A * 5/1995 Erkocevic ..... 343/828
7,129,907 B2 * 10/2006 Lin et al. ..... 343/876
7,760,150 B2 * 7/2010 Sato ..... 343/724

OTHER PUBLICATIONS

Koo, Gwan-Bon, "Application Note: AN-4147 Design Guidelines for RCD Snubber of Flyback Converters," Fairchild Semiconductor (2006).

* cited by examiner

*Primary Examiner* — Michael C Wimer
(74) *Attorney, Agent, or Firm* — Lowenstein Sandler LLP

(57) ABSTRACT

Antenna structures and methods of operating the same of a configurable antenna of an electronic device are described. A configurable antenna includes a first antenna element coupled to a radio frequency (RF) feed, a controllable circuit coupled to the first antenna element and a second antenna element coupled to the controllable circuit. The controllable circuit is configured to electrically isolate the first antenna element and the second antenna element to configure the antenna structure to operate in a first antenna configuration having a first length and to electrically connect the first antenna element and the second antenna element to configure the antenna structure to operate in a second antenna configuration having a second length.

23 Claims, 8 Drawing Sheets

CONFIGURABLE ANTENNA

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high-band. One resonant mode in the lower frequency band and one resonant mode in the high-band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
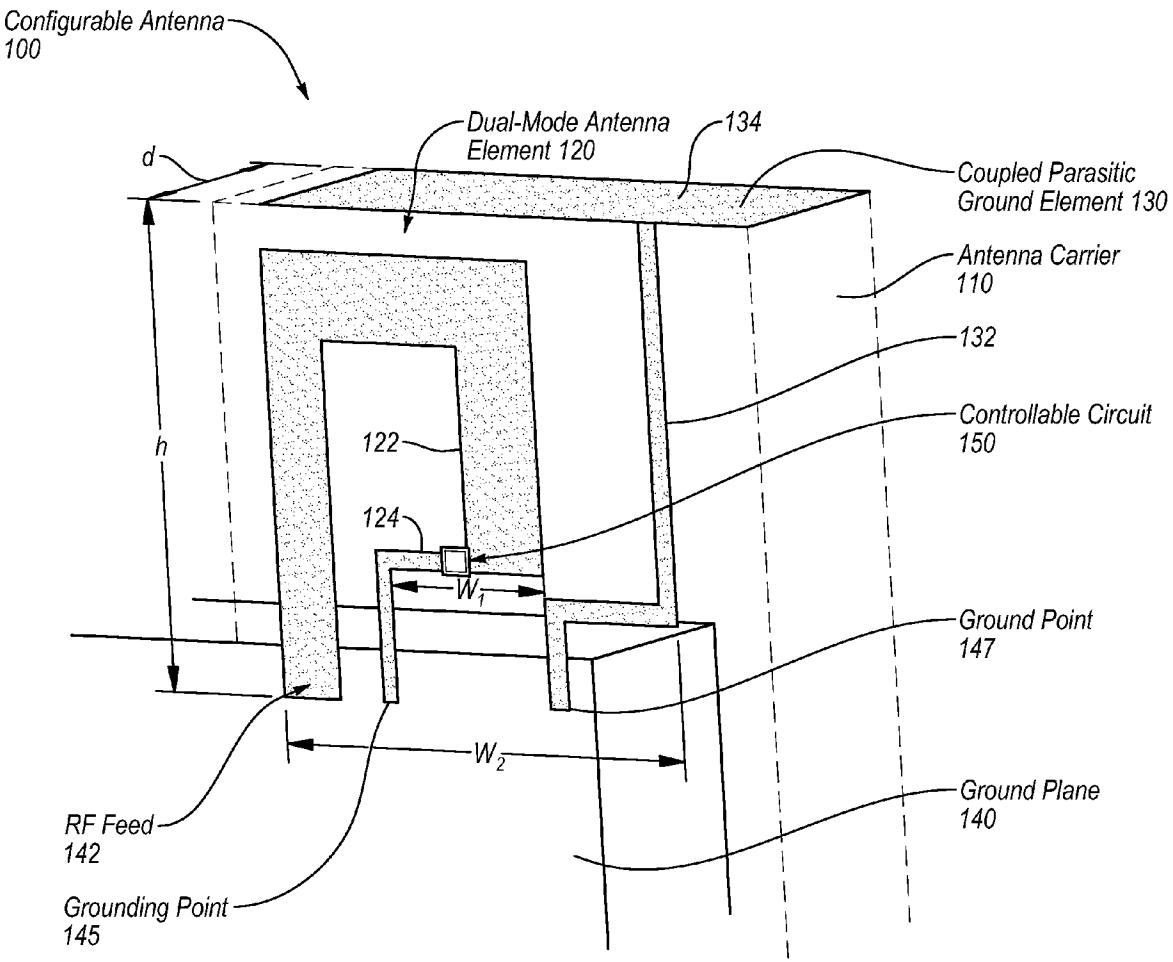
FIG. 1 illustrates one embodiment of a configurable antenna including a dual-mode antenna element and a parasitic ground element.

Antenna structures and methods of operating the same of a configurable antenna of an electronic device are described. A configurable antenna includes a first antenna element coupled to a radio frequency (RF) feed, a controllable circuit coupled to the first antenna element and a second antenna element coupled to the controllable circuit. The controllable circuit is configured to electrically isolate the first antenna element and the second antenna element to configure the antenna structure to operate in a first antenna configuration having a first length and to electrically connect the first antenna element and the second antenna element to configure the antenna structure to operate in a second antenna configuration having a second length. The antenna structure in the first antenna configuration can be a monopole antenna and the antenna structure in the second antenna configuration can be a loop antenna. In further embodiments, the antenna structure of the configurable antenna may further include a parasitic ground element, and the antenna structure in the first antenna configuration becomes a coupled monopole antenna and the antenna structure in the second antenna configuration becomes a coupled loop antenna. The configurable antenna can be used to change the resonance frequencies of the electronic device, such as to cover two different high bands. The controllable circuit can be used to control the physical length and the current flow to induce different antenna modes, such as in the case of a coupled monopole antenna for the first antenna configuration to cover a first frequency range of about 1.71 GHz to about 2.17 GHz and a coupled loop antenna for the second antenna configuration to cover a second frequency range of about 2.5 GHz to about 2.69 GHz. Alternatively, the second frequency range of about 2.3 GHz to about 2.4 GHz. The controllable circuit can be a diode or a switch to switch between the two antenna types. It should be noted that the controllable circuit can also be used to switch between same types of antennas with different lengths as described herein.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high-band. The embodiments described herein increase the capabilities of the antenna to be configurable or length-configurable, as described herein, to cover additional resonant modes. In one embodiment, the configurable antenna includes a dual-mode antenna element that operates as a feeding structure to a parasitic ground element disposed near the configurable antenna. The configurable antenna has a single RF feed that drives the first antenna element or the first and second antenna elements as an active or driven element and the parasitic ground element as a passive, parasitic element that is fed by the first antenna element or the first and second antenna elements. By coupling the driven element and the passive element, additional resonant modes can be created or existing resonant modes can be improved, such as decreasing the reflection coefficient or extending the bandwidth. The proposed configurable antenna can use two resonant modes to cover a range of about 1.71 GHz to about 2.17 GHz in a first mode and to cover a range of about 2.5 GHz to about 2.69 GHz in a second mode. Alternatively, the proposed configurable antenna can use two resonant modes to cover a range of about 1.71 GHz to about 2.17 GHz in a first mode and to cover a range of about 2.3 GHz to about 2.4 GHz in a second mode. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes, for example, a first high-band mode and a second high-band mode. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein provide a configurable antenna to be coupled to a single RF feed and does not use any active tuning to achieve the extended bandwidths. The embodiments described herein also provide a configurable antenna with increased bandwidth in a size that is conducive to being used in a user device.

FIG. 1 illustrates one embodiment of a configurable antenna 100 including a dual-mode antenna element 120 and a parasitic ground element 130. In this embodiment, the configurable antenna 100 is fed at the single RF feed 142 that is coupled to the dual-mode antenna element 120. The parasitic ground element 130 is a parasitic element. A parasitic element is an element of the configurable antenna 100 that is not driven directly by the single RF feed 142. Rather, the single RF feed 142 directly drives another element of the configurable antenna (e.g., the dual-mode antenna element 120), which parasitically induces a current on the parasitic element. In particular, by directly applying current on the other element by the single RF feed 142, the directly-fed element radiates electromagnetic energy, which induces another current on the parasitic element to also radiate electromagnetic energy. In the depicted embodiment, the parasitic ground element 130 is parasitic because it is physically separated from the dual-mode antenna element 120 that is driven at the single RF feed 142, but is laid out so as to form a coupling between the two elements. The driven dual-mode antenna element 120 parasitically excites the current flow of the parasitic ground element 130. In one embodiment, the parasitic ground element 130 and dual-mode antenna element 120 can be physically separated by a gap. Alternatively, other antenna configurations may be used to include a driven element and a parasitic element. The dimensions of the dual-mode antenna element 120 and the parasitic ground element 130 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 1, the ground is represented as the radiation ground plane 140. The ground plane 140 may be a metal frame of the user device. The ground plane 140 may be a system ground or one of multiple grounds of the user device. The RF feed 142 may be a feed line connector that couples the configurable antenna 100 to a feed line (also referred to as the transmission line), which is a physical connection that carries the RF signal to and/or from the configurable antenna 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to dual-mode antenna element 120 of the configurable antenna 100, but is not conductively connected to the parasitic ground element 130 of the configurable antenna 100. However, the dual-mode antenna element 120 is configured to operate as a feeding structure to the parasitic ground element 130. That is the dual-mode antenna element 120 parasitically induces current at the parasitic ground element 130 as described above. The phrase "conductively connected," as used herein, indicates that the two antenna elements have a connection between them that allows for conduction of current. For example, one element can be physically connected to the other element and this physical connection allows current to flow between the two antenna elements. In other contexts, for purposes of comparison, two elements can be coupled or form a "coupling," without being physically connected. For example, two antenna elements can be disposed in a way to form a capacitive coupling between the two antenna elements or an inductive coupling between the two antenna elements.

In one embodiment, the configurable antenna 100 is disposed on an antenna carrier 110, such as a dielectric carrier of the user device. The antenna carrier 110 may be any non-conductive material, such as dielectric material, upon which the conductive material of the configurable antenna 100 can be disposed without making electrical contact with other metal of the user device. In another embodiment, the configurable antenna 100 is disposed on, within, or in connection with a circuit board, such as a printed circuit board (PCB). In one embodiment, the ground plane 140 may be a metal chassis of a circuit board. Alternatively, the configurable antenna 100 may be disposed on other components of the user device or within the user device as would be appreciated by one of ordinary skill in the art having the benefit of this disclosure. It should be noted that the configurable antenna 100 illustrated in FIG. 1 is a three-dimensional (3D) structure. However, as described herein, the configurable antenna 100 may include two-dimensional (2D) structures, as well as other variations than those depicted in FIG. 1.

In the depicted embodiment, the dual-mode antenna element 120 includes a first antenna element 122, a second antenna element 124, and a controllable circuit 150. The first antenna element 122 is coupled to the single RF feed 142 and the controllable circuit 150. The second antenna element 124 is coupled to the controllable circuit 150 and the ground plane 140 at grounding point 145. The parasitic ground element 130 is coupled to the ground plane 140 at grounding point 147.

In the depicted embodiment, the first antenna element 122 includes three portions: a first portion that extends from the RF feed 142 in a first direction until a first fold; a second portion that extends from the first fold in a second direction until a second fold; and a third portion that extends from the second fold in a third direction and is laid out at least partially in parallel to the first portion. The second portion may be laid out to be at least partially perpendicular to the first portion.

The controllable circuit 150 is disposed at a distal end of the third portion. The distal end is the farthest end away from the RF feed 142. It should be noted that a "fold" refers to a bend, a corner, or other change in direction of the antenna element. For example, the fold may be where one segment of an antenna element changes direction in the same plane or in a different plane. Typically, folds in antennas can be used to fit the entire length of the antenna within a smaller area or smaller volume of a user device.

In the depicted embodiment, the second antenna element 124 includes two portions: a fourth portion that extends from the controllable circuit 150 in a fourth direction until a fourth fold and is laid out at least partially in parallel to the second portion; and a fifth portion that extends from the fourth fold to the ground plane 140 and is laid out at least partially in parallel to the first portion (and the third portion).

In the depicted embodiment, the parasitic ground element 130 is not conductively connected to the RF feed 142. The parasitic ground element 130 includes a meandering ground line 132 and a block portion 134. The meandering ground line 132 includes a sixth portion that extends from the ground plane 140 in the first direction until a fifth fold; a seventh portion that extends from the fifth fold in the second direction until a sixth fold; and an eighth portion that extends from the sixth fold in the first direction until a seventh fold. The block portion 134 is coupled to a distal end of the eighth portion, the distal end being the end of the eighth portion that is farthest from the ground plane 140. In the depicted embodiment, the block portion extends in the second direction and fourth direction and is laid out at least partially in parallel to the second portion. Although the depicted embodiment illustrates the parasitic ground element as having a meandering ground line and a block portion, in other embodiments other structures can be used, such as a monopole, a folded monopole, or other structure based on the available space and overall antenna design.

In this embodiment, the configurable antenna 100 is a 3D structure as illustrated in the top perspective view of FIG. 1. The dual-mode antenna element 120 and parasitic ground element 130 are 3D structures that can wrap around different sides of the antenna carrier 110. In particular, in the depicted embodiment, the dual-mode antenna element 120, including the first portion, second portion, third portion, fourth portion, and fifth portion, and the meandering ground line 132, including the sixth, seventh, and eighth portions, are disposed in a first plane (e.g., front surface of the antenna carrier 110). The block portion 134 is disposed in a second plane (e.g., top surface of the antenna carrier 110). Also, as described above, these elements of the configurable antenna 100 can be disposed to be coplanar as a 2D structure.

The configurable antenna 100 may have various dimensions based on the various design factors. In one embodiment, the configurable antenna 100 has an overall height (h), an overall width ($W_2$), and an overall depth (d) (illustrated in FIG. 1). The overall height (h) may vary, but, in one embodiment, is about 14 mm. The overall width ($W_2$) may vary, but, in one embodiment, is about 12 mm. The overall depth may vary, but, in one embodiment, is about 4 mm. Also, a width in between the fifth portion of the dual-mode antenna element and the sixth portion of the meandering ground line 132 has a width ($W_1$) of about 5 mm.

Figure 2:
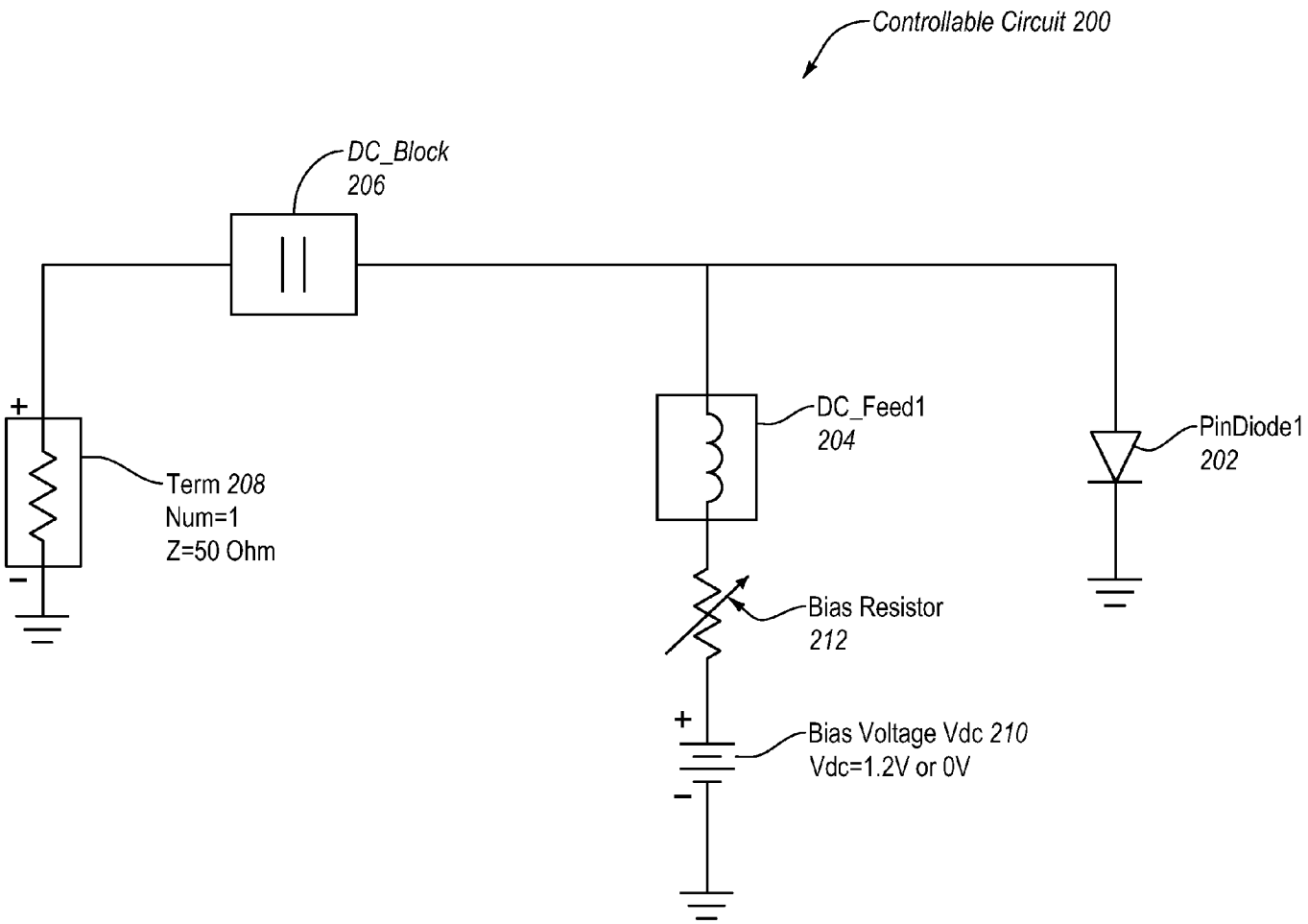
FIG. 2 is an equivalent circuit diagram of a controllable circuit according to one embodiment.

In one embodiment, the controllable circuit 150 includes a pin diode, as illustrated in FIG. 2. The pin diode may be configured to operate as an RF short when biased by a first bias voltage and as an RF open when biased by a second bias voltage. An RF short is when the pin diode is configured substantially as a short-circuit at RF frequencies. Also, the RF short occurs when the impedance between the two antenna elements is very small (zero ohms in an ideal scenario). An RF open is when the pin diode is configured substantially as an open-circuit at RF frequencies. The RF open circuit occurs when the impedance between the two antenna elements is very large (infinite in an ideal scenario) as described and illustrated with respect to FIG. 3. In this embodiment, a processing device of the electronic device can control the pin diode using the first bias voltage and second bias voltage. In another embodiment, the controllable circuit 150 includes a switch that is configured to operate as an RF short when the switch is activated and as an RF open when the switch is deactivated. In this embodiment, a processing device can use a control signal to control the state of the switch.

During operation, the controllable circuit 150 is configured to electrically isolate or electrically connect the first antenna element 122 and the second antenna element 124 to configure the physical structure of the configurable antenna 100, such as changing the length or the type of the antenna structure of the dual-mode antenna element 120. For example, the controllable circuit 150 can configure the dual-mode antenna element 120 to operate in a first antenna configuration in a first mode and in a second antenna configuration in a second mode. In particular, the controllable circuit 150 can electrically isolate the first antenna element 122 from the second antenna element 124 to operate the dual-mode antenna element 120 as a monopole antenna in the first antenna configuration in the first mode, and the controllable circuit 150 can electrically connect the first antenna element 122 and the second antenna element 124 to operate as a loop antenna in the second antenna configuration in the second mode. Due to the parasitic ground element, the first antenna (i.e., dual-mode antenna element 120 in the first configuration) is a coupled monopole antenna and the second antenna (i.e., dual-mode antenna element 120 in the second configuration) is a coupled loop antenna, as illustrated and described with respect to FIGS. 4-5.

In the depicted embodiment, the antenna types of the first and second antennas are different, i.e., a monopole antenna and a loop antenna. In another embodiment, the antenna types may be different combinations of monopole, or loop antennas as would be appreciated by one of ordinary skill in the art. In other embodiments, the controllable circuit 150 can be used to configure the configurable antenna 100 into two antennas that are the same type, i.e., such as two monopole antennas with different overall lengths. It should also be noted that other shapes for the dual-mode antenna element 120 are possible. For example, the first antenna element 122 and the second antenna element 124 can have various bends, such as to accommodate placement of other components, such as a speakers, microphones, USB ports.

Strong resonances are not easily achieved within a compact space within user devices, especially within the spaces on smart phones and tablets. The structure of the configurable antenna 100 provides strong resonances at a first frequency range of about 1.71 GHz to about 2.17 GHz in the first mode and at a second frequency range of about 2.5 GHz to about 2.69 GHz in the second mode. These are both high-band modes, but the antenna structure can be designed to operate in low-band modes. Strong resonances, as used herein, refer to a significant return loss at those frequency bands, which is better for impedance matching to 50-ohm systems. These multiple strong resonances can provide an improved antenna design as compared to conventional designs.

In this embodiment, the configurable antenna 100 includes two antenna elements and one controllable circuit. In other embodiments, more antenna elements and controllable circuits can be used to configure the physical structure of the configurable antenna 100. In one embodiment, a second controllable circuit (not illustrated) is coupled to the second antenna element and a third antenna element is coupled to the second controllable circuit. The second controllable circuit is configured to electrically isolate the second antenna element and the third antenna element to configure the antenna structure to operate in the second antenna configuration having the second length and to electrically connect the second antenna element and the third antenna element to configure the antenna structure to operate in a third antenna configuration having a third length. The antenna structure in the first antenna configuration may operate in a first frequency range, the antenna structure in the second antenna may operate in a second frequency range, and the antenna structure in the third antenna configuration may operate in a third frequency range. For example, the antenna structure may be a first monopole antenna with a first length in the first antenna configuration, the antenna structure may be a second monopole antenna having a second length in the second antenna configuration, and the antenna structure may be a loop antenna in the third antenna configuration. Alternatively, other combination of different types of antennas or different length of antennas may be formed using one or more controllable circuits as would be appreciated by one of ordinary skill in the art having the benefit of this disclosure.

FIG. 2 is an equivalent circuit diagram of a controllable circuit 200 according to one embodiment. The controllable circuit 200 includes a bias voltage (Vdc) 210 that can be set to multiple bias voltages and a pin diode 202. The pin diode 202 may be configured to operate as an RF short when biased by a first bias voltage 210, such as, for example, 1.2 volts, and to operate as an RF open when not biased (e.g., 0 volts).

The equivalent circuit diagram also illustrates an impedance matching circuit, including a DC_block 206 that represents the capacitive component of the impedance matching circuit and a DC_feed1 204 that represents the inductive component of the impedance matching circuit. The DC_feed 1 204 is in parallel to the pin diode 202, and the DC_block 206 is in series between the pin diode 202 and a terminal 208. A bias resistor 210 is disposed in between the DC_feed 1 204 and the bias voltage 210. The bias resistor 210 can provide current control for the pin diode 202. The bias resistor 210 can be a fixed resistor a variable resistor. A processing device, such as described herein, can be used to control the bias voltage 210. For example, the processing device can switch in different bias voltage sources, or can change the value of the bias voltage as would be appreciated by one of ordinary skill in the art.

In the depicted embodiment, the controllable circuit 200 includes a pin diode 202. In other embodiments, other types of diodes may be used. Also, as described above, in other embodiments, the controllable circuit includes a switch that is configured to operate as an RF short when the switch is activated and as an RF open when the switch is deactivated. In this embodiment, a processing device can use a control signal to control the state of the switch. Alternatively, other circuits can be used for the controllable circuit to configure a physical structure of the configurable antenna 100, such as changing the type of the antenna structure, as illustrated in FIG. 1, or changing an overall length of the antenna structure.

Figure 3:
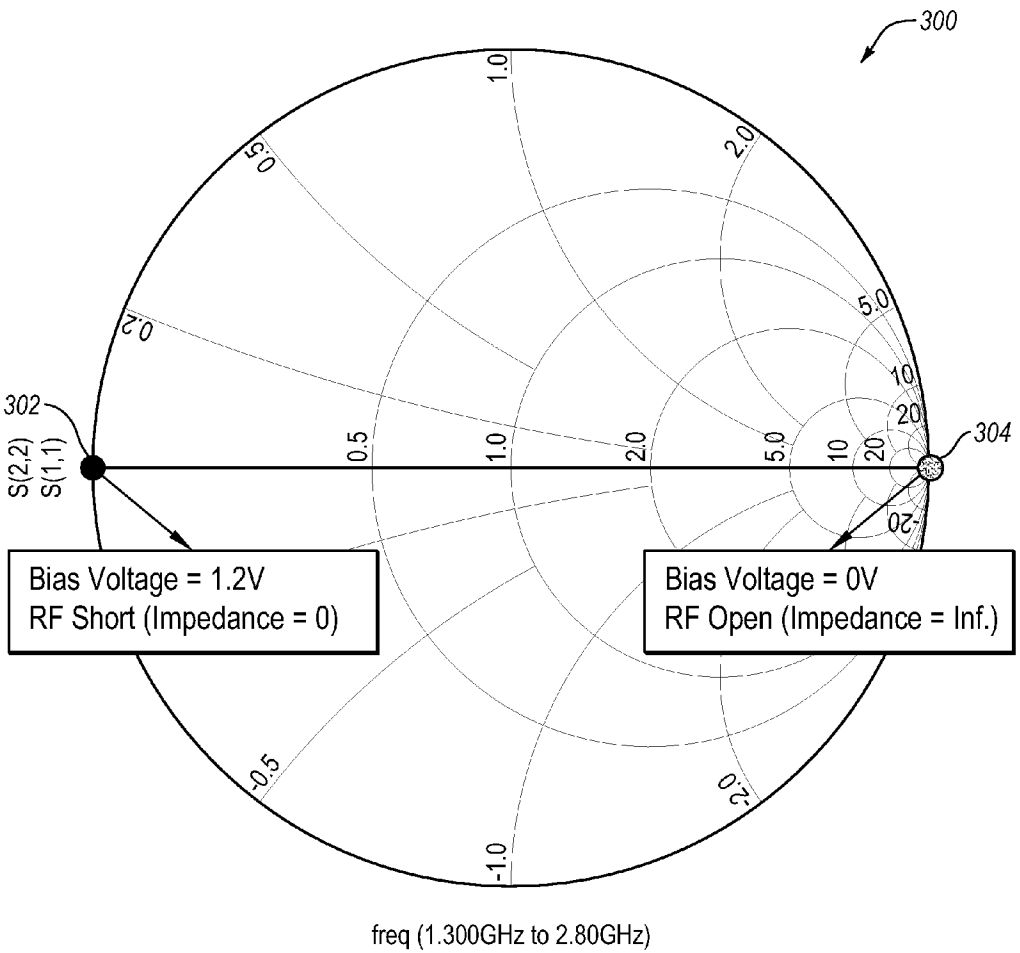
FIG. 3 is a Smith chart of an input impedance of the configurable antenna of FIG. 1 according to one embodiment.

FIG. 3 is a Smith chart 300 of an input impedance of the configurable antenna 100 according to one embodiment. The Smith chart 300 illustrates how the impedance is zero when the bias voltage of the controllable circuit is set (e.g., 1.2 V) to configure the controllable circuit as an RF short. The Smith chart 300 also illustrates how the impedance is infinite when the bias voltage of the controllable circuit is set (e.g., 0 V) to configure the controllable circuit as an RF open.

Figure 4:
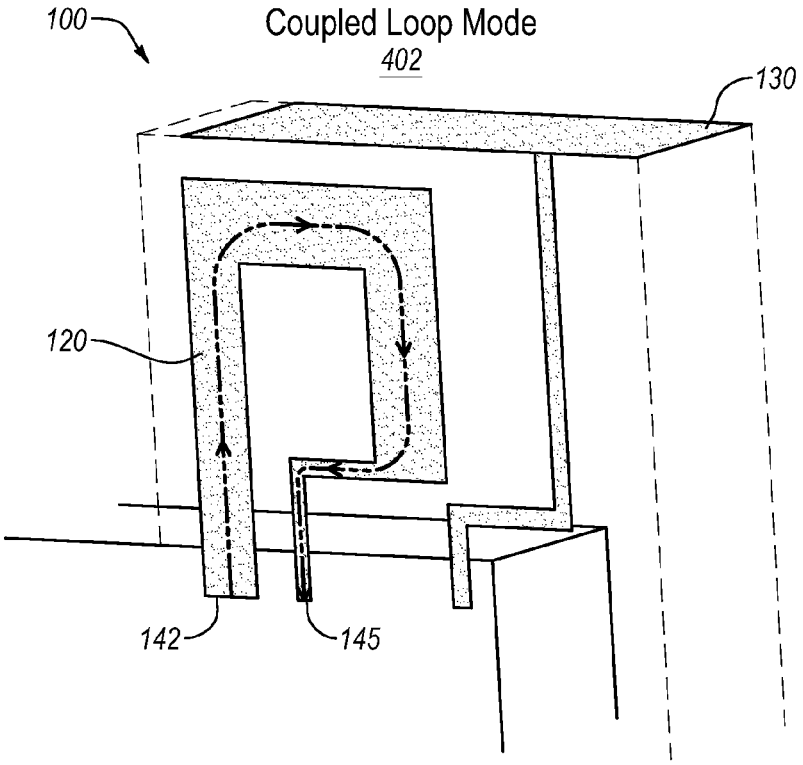
FIG. 4 is the configurable antenna configured to operate as a coupled loop antenna in a coupled loop mode according to one embodiment.
Figure 5:
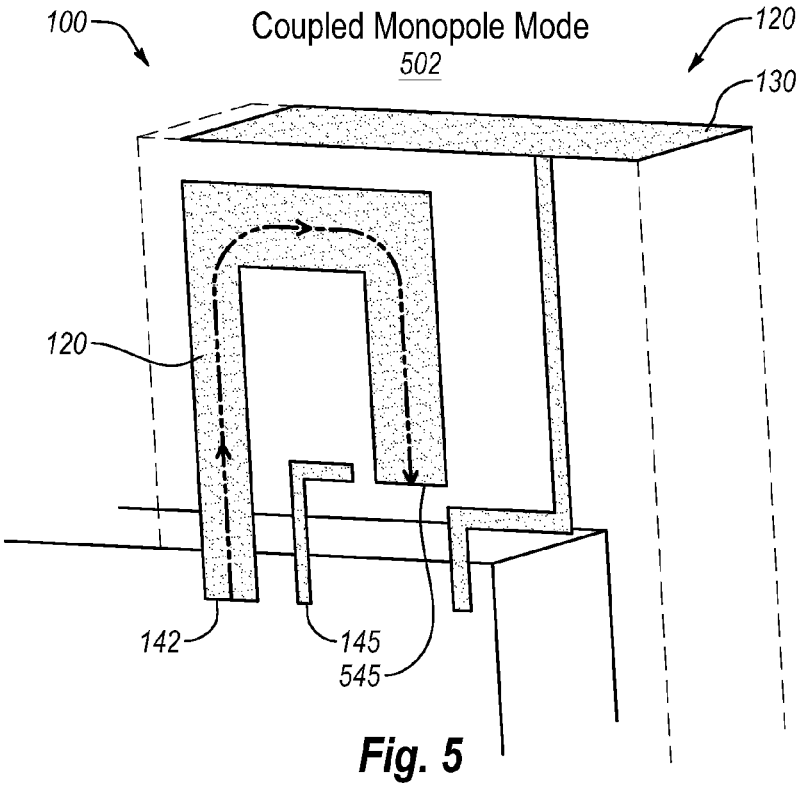
FIG. 5 is the configurable antenna configured to operate as a coupled monopole antenna in a coupled monopole mode according to one embodiment.

FIGS. 4-5 illustrate the two modes of the configurable antenna 100. In particular, FIG. 4 illustrates when the controllable circuit is set to be an RF open (e.g., 0V bias voltage), causing the dual-mode antenna element 120 to operate as a coupled loop antenna in a coupled loop mode 402. The arrow of FIG. 4 illustrates a current flow of the dual-mode antenna element 120 that flows from the RF feed 142 to the grounding point 145 in the coupled loop mode 402. FIG. 5 illustrates when the controllable circuit is set to be an RF short (e.g., 1.2V bias voltage), causing the dual-mode antenna element 120 to operate as a coupled monopole antenna in a coupled monopole mode 502. The arrow of FIG. 5 illustrates a current flow of the dual-mode antenna element 120 that flows from the RF feed 142 to a distal end 545 of the dual-mode antenna element 120 in the coupled monopole mode 502, flowing from the RF feed 142 to the grounding point 145.

Figure 6:
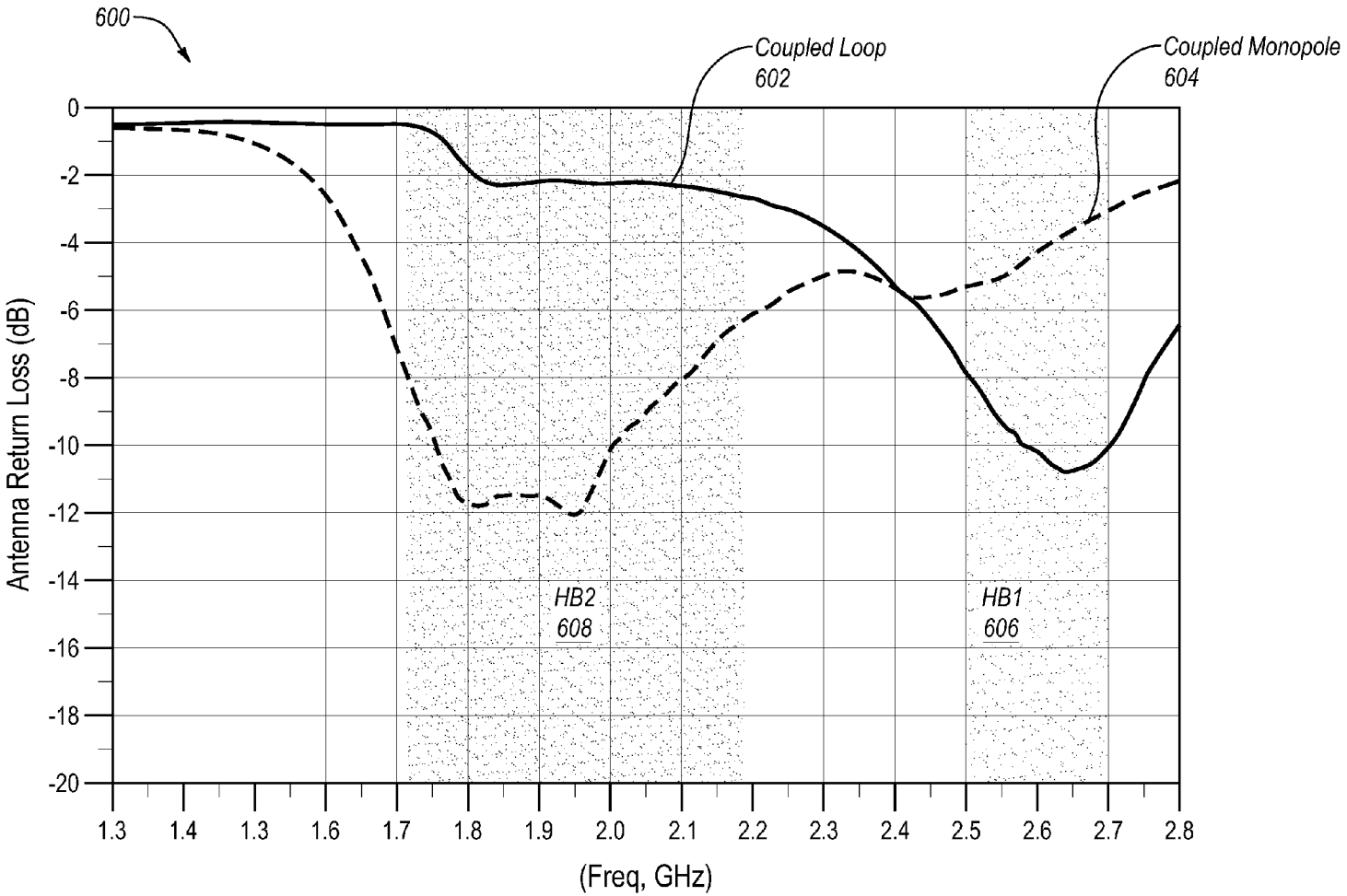
FIG. 6 is a graph of measured return loss of the two configurations of the configurable antenna of FIG. 1 according to one embodiment.

FIG. 6 is a graph of measured return loss 602, 604 of the two configurations of the configurable antenna 100 of FIG. 1 according to one embodiment. The graph 600 shows the measured return loss 602 of the coupled loop antenna, i.e., when the controllable circuit 150 is a RF short to cause the configurable antenna 100 of FIG. 1 to operate as the coupled loop antenna in the first configuration. The graph 600 also shows the measured reflection return loss 604 of the coupled monopole antenna, i.e., when the controllable circuit 150 is a RF open to cause the configurable antenna 100 of FIG. 1 to operate as the coupled monopole antenna in the second configuration.

The configurable antenna 100 provides a resonant mode of those respective frequencies in the different modes of operation when the controllable circuit 150 configures the configurable antenna 100 into the different configurations. That is the configurable antenna 100 decreases the return loss at the corresponding frequencies to create or form a first high-band (HB1) 606 or a second high-band (HB2) 608. In one embodiment, the configurable antenna 100 covers a range of about 2.5 GHz to about 2.69 GHz in HB1 606 when configured to operate as the coupled loop antenna and covers a range of about 1.71 GHz to about 2.17 GHz in HB2 608 when configured to operate as the coupled monopole antenna. As described herein, other resonant modes may be achieved. Also, other frequency ranges may be covered by different designs of the configurable antenna as would be appreciated by one of ordinary skill in the art having the benefit of this disclosure. The terms "first," "second," "third," "fourth," etc. as used herein are meant as labels to distinguish among different elements and may not necessarily have an ordinal meaning according to their numerical designation.

Figure 7:
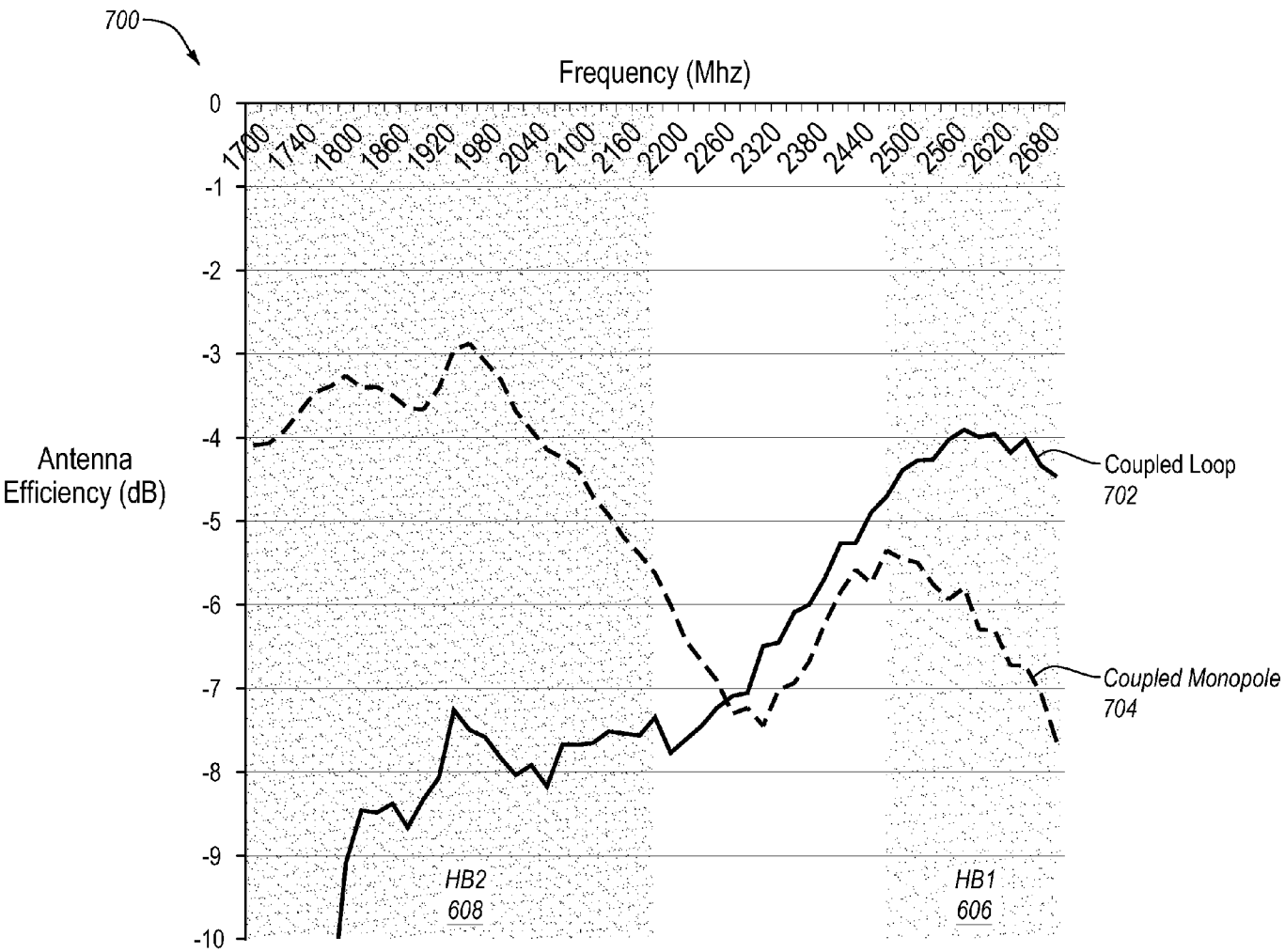
FIG. 7 is a graph of measured efficiencies of the two configurations of the configurable antenna of FIG. 1 according to one embodiment.

FIG. 7 is a graph 700 of measured efficiencies 702, 704 of the two configurations of the configurable antenna of FIG. 1 according to one embodiment. The graph 700 illustrates the total efficiency 702 of the coupled loop antenna over a frequency range in HB1 606, i.e., when the controllable circuit 150 is a RF short circuit to cause the configurable antenna 100 of FIG. 1 to operate as the coupled loop antenna in the first configuration. The graph 700 also illustrates the total efficiency 704 of the coupled monopole antenna over a frequency range in HB2 608, i.e., when the controllable circuit 150 is a RF short circuit to cause the configurable antenna 100 of FIG. 1 to operate as the coupled loop antenna in the first configuration. The graph 700 illustrates that the configurable antenna 100 is a viable antenna for the respective frequency range in the two configurations. As described above, in this embodiment, the configurable antenna 100 covers a range of about 2.5 GHz to about 2.69 GHz in HB1 606 when configured to operate as the coupled loop antenna and covers a range of about 1.71 GHz to about 2.17 GHz in HB2 608 when configured to operate as the coupled monopole antenna.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The efficiency of the configurable antenna may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

Figure 8:
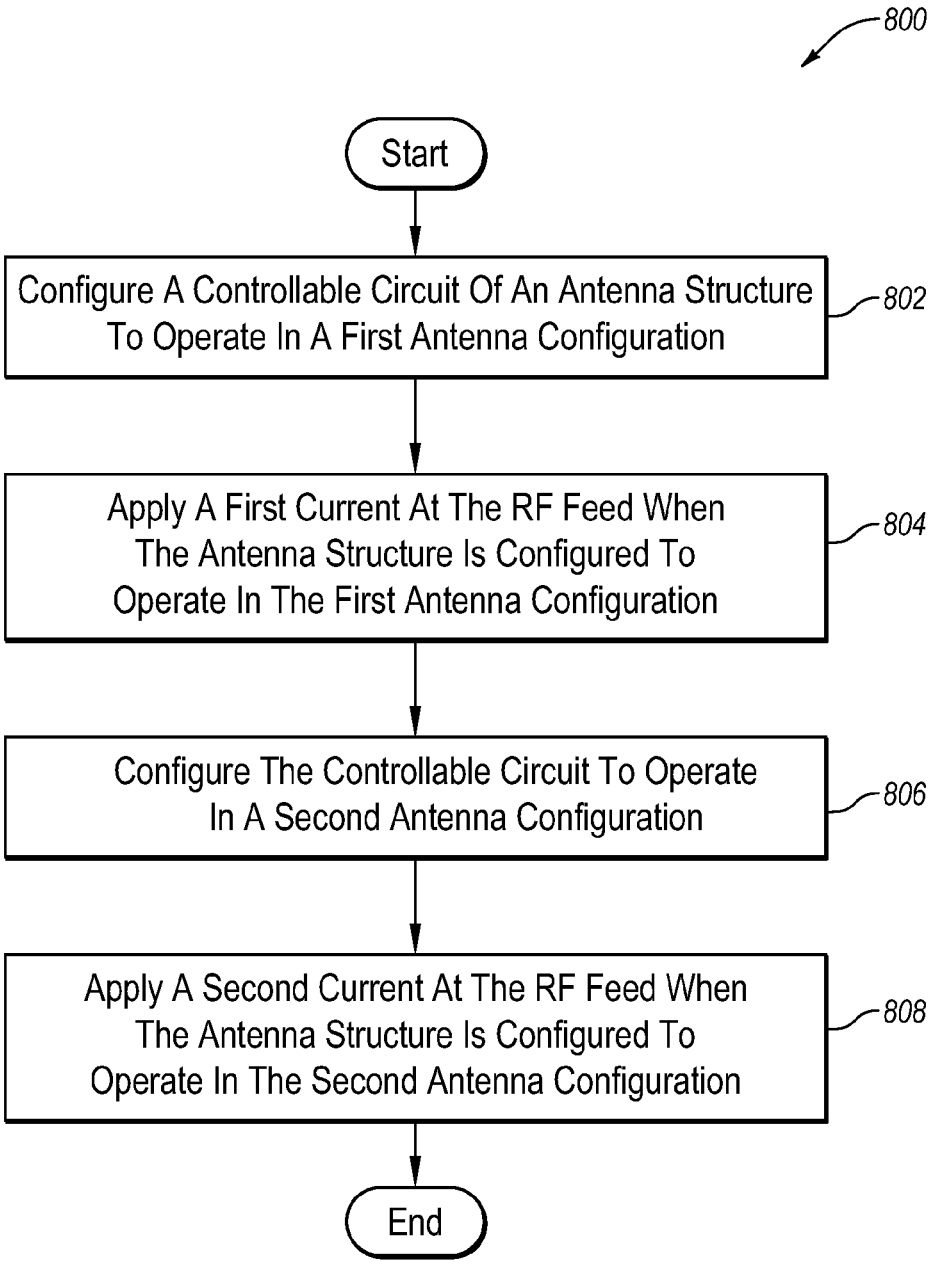
FIG. 8 is a flow diagram of an embodiment of a method of operating a user device having a configurable antenna according to one embodiment.

FIG. 8 is a flow diagram of an embodiment of a method 800 of operating an electronic device having a configurable antenna according to one embodiment. The method 800 is performed by processing logic of the electronic device that may comprise hardware (circuitry, dedicated logic, etc.), software (such as is run on a general-purpose computing system or a dedicated machine), or a combination of both. In one embodiment, the user device 905 of FIG. 9 performs the method 800. Alternatively, other processing components of an electronic device can be configured to perform some or all of the method 800.

Referring to FIG. 8, method 800 begins by the processing logic configures a controllable circuit of an antenna structure to operate in a first antenna configuration (block 802). The antenna structure includes a first antenna element, which is coupled to a RF feed, and a second antenna element that can be switched in and out to connect and disconnect from the first antenna element. At least a portion of the controllable circuit is disposed between the first antenna element and the second antenna element. In the first antenna configuration, the controllable circuit electrically isolates the second antenna element from the first antenna element in the first antenna configuration. The processing logic applies a first current at the RF feed when the antenna structure is configured to operate in the first antenna configuration (block 804). The processing logic configures the controllable circuit to operate in a second antenna configuration (block 806). The processing logic applies a second current at the RF feed when the antenna structure is configured to operate in the second antenna configuration (block 808). When switched in, the first and second antenna elements may operate as a loop antenna and, when not switched in, the first antenna element may operate as a monopole antenna.

In a further embodiment, the processing logic causes the application of the first current to the RF feed to radiate electromagnetic energy from the first antenna element in the first configuration and causes the application of the second current to the RF feed to radiate electromagnetic energy from the first antenna element and the second antenna element in the second configuration. The electromagnetic energy forms a radiation pattern. The radiation pattern may be various shapes as would be appreciated by one of ordinary skill in the art having the benefit of this disclosure.

In another embodiment, the configurable antenna further includes a parasitic ground element coupled to a ground plane. The application of the first current parasitically induces a third current at the parasitic ground element in the first antenna configuration and the application of the second current parasitically induces a fourth current at the parasitic ground element in the second antenna configuration. The application of the first current and the parasitic induction of the third current may cause the first antenna element and the parasitic ground element to radiate electromagnetic energy to communicate information to another device in the first configuration. The application of the second current and the parasitic induction of the fourth current may cause the first antenna element, second antenna element and the parasitic ground element to radiate electromagnetic energy to communicate information to another device in the second configuration. By inducing current flow at the parasitic ground element, bandwidth of the configurable antenna may be increased. The antenna structure of the configurable antenna can provide different resonant modes for a high-band. For example, the antenna structure in the first antenna configuration provides multiple resonant modes. In one embodiment, the antenna structure provides two resonant modes in the low-band and two resonant modes in the high-band. As described herein, the parasitic ground element is physically separated from the dual-mode antenna element 120 by a gap. In a further embodiment, the processing logic cause the first antenna element and the parasitic ground element to radiate the electromagnetic energy at a first frequency range of about 1.71 GHz to about 2.17 GHz in the first configuration. The processing logic also causes the first antenna element, second antenna element and the parasitic ground element to radiate the electromagnetic energy at a second frequency range of about 2.5 GHz to about 2.69 GHz in the second configuration.

In another embodiment of the method, the controllable circuit of the antenna structure is controlled to operate in a first antenna configuration. The antenna structure includes a first antenna element coupled to the RF feed and the controllable circuit. The antenna structure further includes a second antenna element coupled to the controllable circuit. A first current is applied at the RF feed when the antenna structure is configured to operate in the first antenna configuration in which the second antenna element is electrically isolated from the first antenna element via the controllable circuit. At another point in time, the controllable circuit is controlled to operate in a second antenna configuration. A second current is applied at the RF feed when the antenna structure is configured to operate in the second antenna configuration in which the second antenna element is electrically connected to the first antenna element via the controllable circuit.

In a further embodiment, electromagnetic energy is radiated from the first antenna element in response to the first current in the first configuration and electromagnetic energy is radiated from the first antenna element and the second antenna element in response to the second current in the second configuration.

In another embodiment, the antenna structure further includes a parasitic ground element coupled to a ground plane. The parasitic ground element is not conductively connected to the RF feed. In response to the applying the first current, a third current is parasitically induced at the parasitic ground element. Electromagnetic energy is radiated form the first antenna element and the parasitic ground element to communicate information to another device in response to the first and third currents in the first configuration. In response to the applying the second current, a fourth current is parasitically induced at the parasitic ground element. Electromagnetic energy is radiated from the first antenna element, second antenna element and the parasitic ground element to communicate information to another device in response to the second and fourth currents in the second configuration. In one embodiment, the electromagnetic energy is radiated at a first frequency range of about 1.71 GHz to about 2.17 GHz in the first configuration and is radiated at a second frequency range of about 2.5 GHz to about 2.69 GHz in the second configuration.

Figure 9:
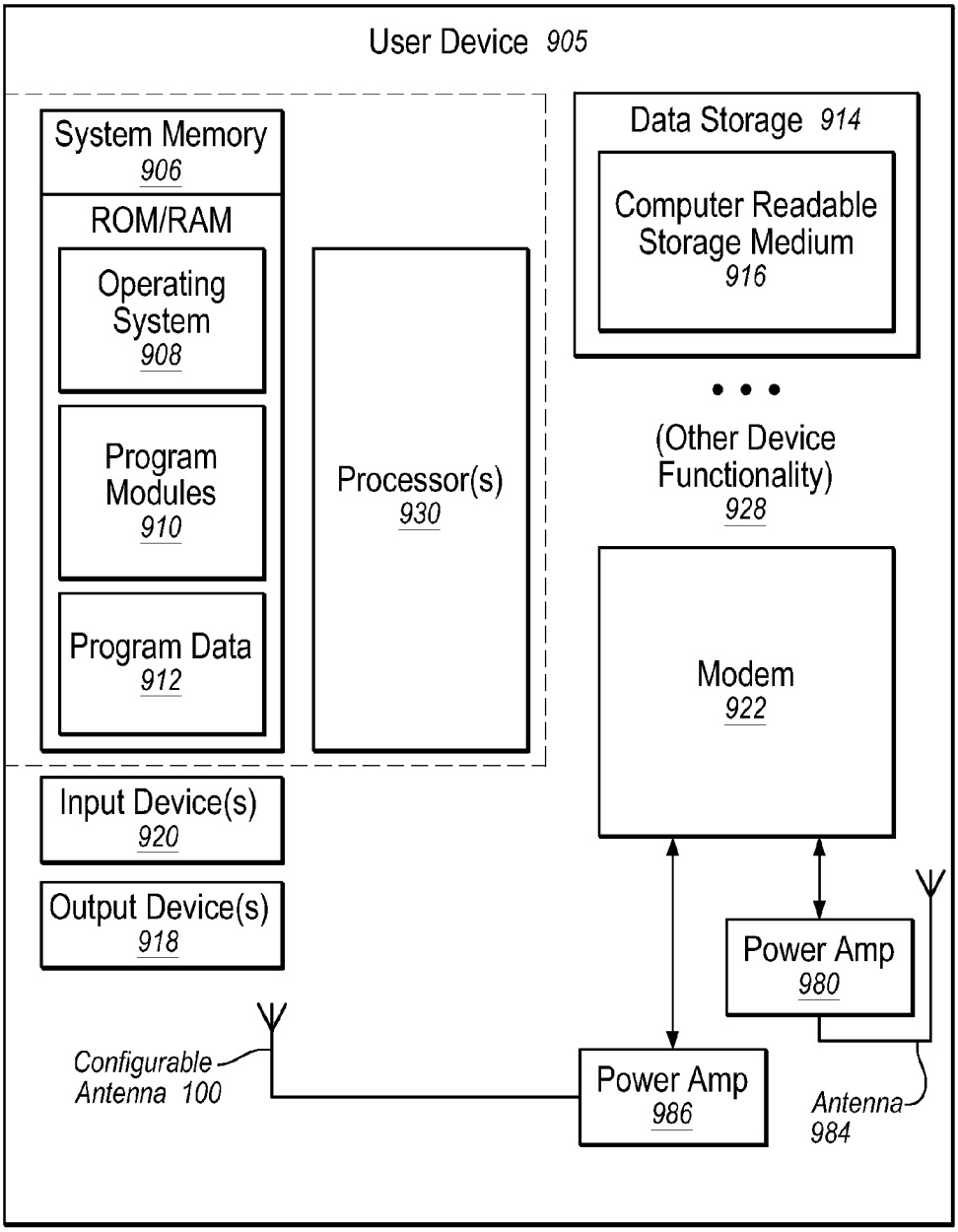
FIG. 9 is a block diagram of a user device having a configurable antenna according to one embodiment.

FIG. 9 is a block diagram of a user device 905 having the configurable antenna 100 of FIG. 1 according to one embodiment. The user device 905 includes one or more processors 930, such as one or more CPUs, microcontrollers, field programmable gate arrays, or other types of processing devices. The user device 905 also includes system memory 906, which may correspond to any combination of volatile and/or non-volatile storage mechanisms. The system memory 906 stores information, which provides an operating system component 908, various program modules 910, program data 912, and/or other components. The user device 905 performs functions by using the processor(s) 930 to execute instructions provided by the system memory 906.

The user device 905 also includes a data storage device 914 that may be composed of one or more types of removable storage and/or one or more types of non-removable storage. The data storage device 914 includes a computer-readable storage medium 916 on which is stored one or more sets of instructions embodying any one or more of the functions of the user device 905, as described herein. As shown, instructions may reside, completely or at least partially, within the computer readable storage medium 916, system memory 906 and/or within the processor(s) 930 during execution thereof by the user device 905, the system memory 906 and the processor(s) 930 also constituting computer-readable media. The user device 905 may also include one or more input devices 920 (keyboard, mouse device, specialized selection keys, etc.) and one or more output devices 918 (displays, printers, audio output mechanisms, etc.).

The user device 905 further includes a wireless modem 922 to allow the user device 905 to communicate via a wireless network (e.g., such as provided by a wireless communication system) with other computing devices, such as remote computers, an item providing system, and so forth. The wireless modem 922 allows the user device 905 to handle both voice and non-voice communications (such as communications for text messages, multimedia messages, media downloads, web browsing, etc.) with a wireless communication system. The wireless modem 922 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® networks), etc. In other embodiments, the wireless modem 922 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 905 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 905 to communicate with other devices, such as other user devices, server computing systems, telephone devices, or the like. In addition to wirelessly connecting to a wireless communication system, the user device 905 may also wirelessly connect with other user devices. For example, user device 905 may form a wireless ad hoc (peer-to-peer) network with another user device.

The wireless modem 922 may generate signals and send these signals to power amplifier (amp) 980 or power amp 986 for amplification, after which they are wirelessly transmitted via the configurable antenna 100 or antenna 984, respectively. Although FIG. 9 illustrates power amps 980 and 986, in other embodiments, a transceiver may be used for all the antennas 100 and 984 to transmit and receive. The antenna 984, which is an optional antenna that is separate from the configurable antenna 100, may be any directional, omnidirectional or non-directional antenna in a different frequency band than the frequency bands of the configurable antenna 100. The antenna 984 may also transmit information using different wireless communication protocols than the configurable antenna 100. In addition to sending data, the configurable antenna 100 and the antenna 984 also receive data, which is sent to wireless modem 922 and transferred to processor(s) 930. It should be noted that, in other embodiments, the user device 905 may include more or less components as illustrated in the block diagram of FIG. 9.

In one embodiment, the user device 905 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the configurable antenna 100 that operates at a first frequency band and the second wireless connection is associated with a second resonant mode of the configurable antenna 100 that operates at a second frequency band. In another embodiment, the first wireless connection is associated with the configurable antenna 100 and the second wireless connection is associated with the antenna 984. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 922 is shown to control transmission to both antennas 100 and 984, the user device 905 may alternatively include multiple wireless modems, each of which is configured to transmit/receive data via a different antenna and/or wireless transmission protocol. In addition, the user device 905, while illustrated with two antennas 100 and 984, may include more or fewer antennas in various embodiments.

The user device 905 delivers and/or receives items, upgrades, and/or other information via the network. For example, the user device 905 may download or receive items from an item providing system. The item providing system receives various requests, instructions and other data from the user device 905 via the network. The item providing system may include one or more machines (e.g., one or more server computer systems, routers, gateways, etc.) that have processing and storage capabilities to provide the above functionality. Communication between the item providing system and the user device 905 may be enabled via any communication infrastructure. One example of such an infrastructure includes a combination of a wide area network (WAN) and wireless infrastructure, which allows a user to use the user device 905 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 905.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 905 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 905 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device, comprising:

a radio frequency (RF) feed; and a configurable antenna coupled to the RF feed, wherein the configurable antenna comprises:

a dual-mode antenna element coupled to the RF feed, wherein the dual-mode antenna comprises a first antenna element and a second antenna element; and a controllable circuit, located between the first antenna element and the second antenna element, connecting the first antenna element and the second antenna element, wherein the controllable circuit is configured to:

electrically isolate the first antenna element from the second antenna element to operate the dual-mode antenna in a first antenna configuration in a first mode; and electrically connect the first antenna element and the second antenna element to operate in a second antenna configuration in a second mode; and a parasitic ground element coupled to a ground plane, wherein:

the parasitic ground element is not conductively connected to the RF feed, the parasitic ground element is parasitically coupled to the dual-mode antenna element, and the parasitic ground element is perpendicular to the dual-mode antenna element.

2. The electronic device of claim 1, wherein the dual-mode antenna is configured to operate as a coupled monopole antenna in the first mode and as a coupled loop antenna in the second mode.

3. The electronic device of claim 2, wherein the coupled monopole antenna is configured to operate in a first frequency range of about 1.71 GHz to about 2.17 GHz and the coupled loop antenna is configured to operate in a second frequency range of about 2.5 GHz to about 2.69 GHz.

4. The electronic device of claim 1, wherein the controllable circuit comprises at least one of a diode or a switch.

5. An apparatus comprising:

a radio frequency (RF) feed;

an antenna structure comprising:

a first antenna element coupled to the RF feed;

a circuit, located between the first antenna element and a second antenna element, connecting the first antenna element to the second antenna element; and the second antenna element coupled to the circuit and parasitically coupled to a ground plane, wherein:

a parasitic ground element is coupled to the ground plane and is perpendicular to the second antenna element; and the circuit is configured to:

electrically isolate the first antenna element and the second antenna element to configure the antenna structure to operate in a first antenna configuration having a first length; and electrically connect the first antenna element and the second antenna element to configure the antenna structure to operate in a second antenna configuration having a second length.

6. The apparatus of claim 5, wherein the circuit is to configure the antenna structure into a first type of antenna in the first antenna configuration and to configure the antenna structure into a second type of antenna in the second antenna configuration.

7. The apparatus of claim 6, wherein the first type is a monopole antenna and the second type is a loop antenna.

8. The apparatus of claim 5, wherein the antenna structure in the first antenna configuration is a first type of antenna and the antenna structure in the second antenna configuration is the same first type of antenna.

9. The apparatus of claim 8, wherein the antenna structure in the first antenna configuration is a first monopole antenna and the antenna structure in the second antenna is a second monopole antenna.

10. The apparatus of claim 5, wherein the circuit comprises a diode, wherein the diode is configured substantially as a short-circuit at RF frequencies when biased by a first bias voltage and substantially as an open-circuit at RF frequencies when biased by a second bias voltage.

11. The apparatus of claim 10, further comprising a processing device coupled to the circuit, wherein the processing device is configured to:

electrically connect the first antenna element and the second antenna element using the first bias voltage; and electrically isolate the first antenna element and the second antenna element the second bias voltage.

12. The apparatus of claim 5, wherein the controllable circuit comprises a switch, wherein the switch is configured substantially as a short-circuit at RF frequencies when the switch is activated and substantially as an open-circuit at RF frequencies when the switch is deactivated.

13. The apparatus of claim 5, wherein the antenna structure is configured to operate in a first frequency range in the first antenna configuration and the antenna structure is configured to operate in a second frequency range in the second antenna configuration.

14. The apparatus of claim 13, wherein the first frequency range is about 1.71 GHz to about 2.17 GHz and the second frequency range is about 2.5 GHz to about 2.69 GHz.

15. The apparatus of claim 5, wherein the antenna structure further comprises:

a second controllable circuit coupled to the second antenna element; and a third antenna element coupled to the second controllable circuit, wherein the second controllable circuit is configured to:

electrically isolate the second antenna element and the third antenna element to configure the antenna structure to operate in the second antenna configuration having the second length; and electrically connect the second antenna element and the third antenna element to configure the antenna structure to operate in a third antenna configuration having a third length.

16. The apparatus of claim 15, wherein the antenna structure is configured to operate in a first frequency range in the first antenna configuration, wherein the antenna structure is configured to operate in a second frequency range in the second antenna configuration, and the antenna structure is configured to operate in a third frequency range in the third antenna configuration.

17. The apparatus of claim 5, wherein the antenna structure in the first antenna configuration comprises:

a first portion that extends from the RF feed in a first direction until a first fold;

a second portion that extends from the first fold in a second direction until a second fold; and a third portion that extends from the second fold in a third direction and is laid out at least partially in parallel to the first portion, wherein the controllable circuit is disposed at a distal end of the third portion, the distal end being the farthest away from the RF feed.

18. The apparatus of claim 17, wherein the second antenna element comprises:

a fourth portion that extends from the controllable circuit in a fourth direction until a fourth fold and is laid out at least partially in parallel to the second portion; and a fifth portion that extends from the fourth fold to a ground plane and is laid out at least partially in parallel to the first portion.

19. The apparatus of claim 18, wherein the parasitic ground element comprises:

a sixth portion that extends from the ground plane in the first direction until a fifth fold;

a seventh portion that extends from the fifth fold in the second direction until a sixth fold;

an eighth portion that extends from the sixth fold in the first direction until a seventh fold; and a block portion coupled to a distal end of the eighth portion, the distal end being the farthest away from the ground plane, wherein the block portion extends in at least one of the second direction or fourth direction and is laid out at least partially in parallel to the second portion.

20. A method of operating an electronic device comprising:

configuring a controllable circuit of an antenna structure to operate in a first antenna configuration, wherein:

the controllable circuit is located between a first antenna element and a second antenna element of the antenna structure;

the controllable circuit connects the first antenna element to the second antenna element the antenna structure comprises a first antenna element and a second antenna element, wherein:

the antenna structure comprises a parasitic ground element coupled to a ground plane, the parasitic ground element is not conductively connected to an RF feed, the parasitic ground element is parasitically coupled to the dual-mode antenna element, the parasitic ground element is perpendicular to the dual-mode antenna element, at least a portion of the controllable circuit is located between the first antenna element and the second antenna element, the controllable circuit electrically isolates the second antenna element from the first antenna element in the first antenna configuration, and the first antenna element is coupled to the RF feed;

applying a first current at the RF feed when the antenna structure is configured to operate in the first antenna configuration;

configuring the controllable circuit of the antenna structure to operate in a second antenna configuration, wherein the controllable circuit electrically connects the second antenna element from the first antenna element in the first antenna configuration; and applying a second current at the RF feed when the antenna structure is configured to operate in the second antenna configuration.

21. The method of claim 20, further comprising:

causing an application of the first current to the RF feed to radiate electromagnetic energy from the first antenna element in the first configuration; and causing an application of the second current to the RF feed to radiate electromagnetic energy from the first antenna element and the second antenna element in in the second configuration.

22. The method of claim 21, wherein:

the application of the first current parasitically induces a third current at the parasitic ground element in the first antenna configuration;

the application of the second current parasitically induces a fourth current at the parasitic ground element in the second antenna configuration;

the application of the first current and the parasitic induction of the third current cause the first antenna element and the parasitic ground element to radiate electromagnetic energy to communicate information to another device in the first configuration; and the application of the second current and the parasitic induction of the fourth current cause the first antenna element, second antenna element and parasitic ground element to radiate electromagnetic energy to communicate information to another device in the second configuration.

23. The method of claim 22, further comprising:

causing the first antenna element and the parasitic ground element to radiate the electromagnetic energy at a first frequency range of about 1.71 GHz to about 2.17 GHz in the first configuration; and causing the first antenna element, second antenna element and parasitic ground element to radiate the electromagnetic energy at a second frequency range of about 2.5 GHz to about 2.69 GHz in the second configuration.

* * * * *